US008608283B1

(12) United States Patent
Phillips et al.

(10) Patent No.: US 8,608,283 B1
(45) Date of Patent: Dec. 17, 2013

(54) NOZZLE ARRAY CONFIGURATION FOR PRINTHEAD DIE

(75) Inventors: Scott E. Phillips, Rochester, NY (US); John Andrew Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/534,031

(22) Filed: Jun. 27, 2012

(51) Int. Cl.
*B41J 2/15* (2006.01)

(52) U.S. Cl.
USPC ..... 347/43

(58) Field of Classification Search
USPC ..... 347/43, 40, 12, 15
See application file for complete search history.

(56) References Cited

U.S. PATENT DOCUMENTS

| | | | | |
|---|---|---|---|---|
| 4,528,576 | A | 7/1985 | Koumura et al. | |
| 6,315,387 | B1 | 11/2001 | Horikoshi | |
| 6,521,513 | B1 | 2/2003 | Lebens et al. | |
| 6,616,267 | B2 | 9/2003 | Weijkamp | |
| 7,350,902 | B2 | 4/2008 | Dietl et al. | |
| 7,575,299 | B2 * | 8/2009 | Otokita | 347/42 |
| 7,926,908 | B2 * | 4/2011 | Mizutani | 347/43 |
| 8,173,030 | B2 | 5/2012 | Lebens et al. | |

* cited by examiner

*Primary Examiner* — Lamson Nguyen
(74) *Attorney, Agent, or Firm* — Peyton C. Watkins

(57) ABSTRACT

An inkjet printhead die includes a first endmost black nozzle of which is disposed proximate the first end of a substrate, and an opposite second endmost black nozzle of which is disposed a distance D1 from the first endmost black nozzle; a first endmost nozzle of which is disposed proximate the first end of the substrate, and an opposite second endmost nozzle of which is disposed a distance D2 from the first endmost cyan nozzle; a first endmost nozzle of which is disposed proximate the first end of the substrate, and an opposite second endmost nozzle of which is disposed a distance D3 from the first endmost nozzle; wherein D2 and D3 substantially equal to each other, and wherein D1 is greater than D2.

18 Claims, 12 Drawing Sheets

NOZZLE ARRAY CONFIGURATION FOR PRINTHEAD DIE

CROSS REFERENCE TO RELATED APPLICATION

Reference is made to commonly assigned U.S. patent application Ser. No. 13/534,048, filed Jun. 27, 2012 by Scott Phillips and Gary Kneezel, entitled "Method of Bi-Directional Printing with Offset Nozzle Arrays," the disclosure of which is herein incorporated by reference.

FIELD OF THE INVENTION

This invention relates generally to the field of printing devices, and more particularly to an inkjet printing device for printing a plurality of different colored dots.

BACKGROUND OF THE INVENTION

Many types of printing systems include one or more printheads that have arrays of dot forming elements that are controlled to make marks of particular sizes, colors, or densities in particular locations on the print media in order to print the desired image. In some types of printing systems the array(s) of dot forming elements extends across the width of the page, and the image can be printed one line at a time. However, the cost of a printhead that includes a page-width array of marking elements is too high for some types of printing applications so a carriage printing architecture is used.

In a carriage printing system (whether for desktop printers, large area plotters, etc.) the printhead or printheads are mounted on a carriage that is moved past the recording medium in a carriage scan direction as the dot forming elements are actuated to make a swath of dots. At the end of the swath, the carriage is stopped, printing is temporarily halted and the recording medium is advanced. Then another swath is printed, typically as the carriage is moved in the opposite direction, so that the image is formed swath by swath. In a carriage printer, the dot forming element arrays are typically disposed along an array direction that is substantially parallel to the media advance direction, and substantially perpendicular to the carriage scan direction. The length of the dot forming element array determines the maximum swath height that can be used to print an image. The longer the array length is the faster the printing throughput, because fewer swaths are needed to print the image. However, a longer array length requires more dot forming elements on a longer printing device, which increases the cost of the printing device. Fast printing throughput can be especially important for black and white documents, such as text documents, so a long array length for black can be more important than a long array length for color arrays.

In an inkjet printhead, the dot forming elements include nozzles that are connected to a supply of ink. In a color printing system, arrays of nozzles for printing different color inks (such as cyan, magenta, yellow and black) are typically separated from each other along the carriage scan direction. Such nozzles can be provided on different printheads. However, it can be advantageous to have nozzle arrays for a plurality of different colors resident on a single printing device within a single printhead. Printing devices that are fabricated using typical manufacturing technologies, including those used in the semiconductor industry, have nozzles on a single device that can be made to be very uniform in characteristics and well aligned to one another. This is advantageous because print quality is improved if the resulting dots are well-aligned to one another, and the printer can operate more reliably if operating conditions (including voltage and pulsewidth for forming dots) can be selected such that they are optimal or nearly optimal for all of the dot forming elements. Having the nozzles for a plurality of colors on a single printhead die also provides a more compact and cost effective configuration.

For carriage printers that use bi-directional printing and eject dots of one color ink on top of dots of a different color ink, it is known that the resultant color depends upon the order of ink laydown. Printing yellow ink on top of cyan ink results in a different color than printing cyan ink on top of yellow ink for example. Typically, the color laydown order is not an issue if one of the two inks is black. U.S. Pat. Nos. 4,528,576; 6,315,387 and 6,616,267 disclose providing additional color nozzle arrays that are symmetrically ordered (for example as cyan, magenta, yellow, magenta and cyan) so that whether printing left to right or right to left it is always possible to have the same color laydown order. In these patents, the different color arrays are separated from each other but in line with each other along the carriage scan direction. In other words, there is no nozzle array direction offset between different cyan, magenta and yellow arrays.

Many carriage printing systems include multipass print modes in which the dots in a given region of the recording medium are formed in a plurality of printing passes. In multipass printing, responsibility for printing each raster line of the image is shared between a plurality of dot forming elements. In this way the nonuniform marking behavior of dot forming elements can be disguised in order to provide improved image quality. For an inkjet printer, multipass printing can provide time for improving the uniformity of ink-media interactions by controlling the pattern of dots that can be printed within one pass, thereby reducing coalescence (i.e. flowing together of ink drops on the surface of the page before they soak into the page). Multipass printing can also enable multitone printing in which multiple dots are printed in the same pixel locations.

Printhead die are typically formed on wafers containing many die that are singulated by dicing, for example, after wafer fabrication. Die cost is roughly proportional to die area. However, wafer cost can also be influenced by the number of wafers of the same type that are produced. Wafers made in high volume are less costly than wafers made in low volume.

Consequently, a need exists for a nozzle array configuration for a printhead die that facilitates faster printing for black, provides excellent nozzle uniformity and alignment, and which can be separated from the wafer in different die sizes so that depending on the details of die singulation, different trade-offs can be provided for die cost and printing throughput, thereby enabling higher wafer fabrication volumes. It is further advantageous if at least one of the resulting printhead die types can address the problems of color laydown order to further improve image quality and printing throughput.

SUMMARY OF THE INVENTION

The present invention is directed to overcoming one or more of the problems set forth above. Briefly summarized, according to one aspect of the invention, the invention resides an inkjet printhead die comprising: a substrate having a first end and a second end opposite the first end; an array of black nozzles disposed along an array direction for ejecting black ink, a first endmost black nozzle of which is disposed proximate the first end of the substrate, and an opposite second endmost black nozzle of which is disposed a distance D1 from the first endmost black nozzle; an array of cyan nozzles for ejecting cyan ink, a first endmost nozzle of which is disposed proximate the first end of the substrate, and an opposite second endmost nozzle of which is disposed a distance D2 from the first endmost cyan nozzle; an array of magenta nozzles for ejecting magenta ink, a first endmost nozzle of which is disposed proximate the first end of the substrate, and an opposite second endmost nozzle of which is disposed a distance D3 from the first endmost nozzle; and an array of yellow nozzles for ejecting yellow ink, a first endmost nozzle of which is disposed proximate the first end of the substrate, and an opposite second endmost nozzle of which is disposed a distance D4 from the first endmost nozzle, wherein D2, D3 and D4 are equal to or substantially equal to each other, and wherein D1 is greater than D2.

DETAILED DESCRIPTION OF THE INVENTION

Figure 1:
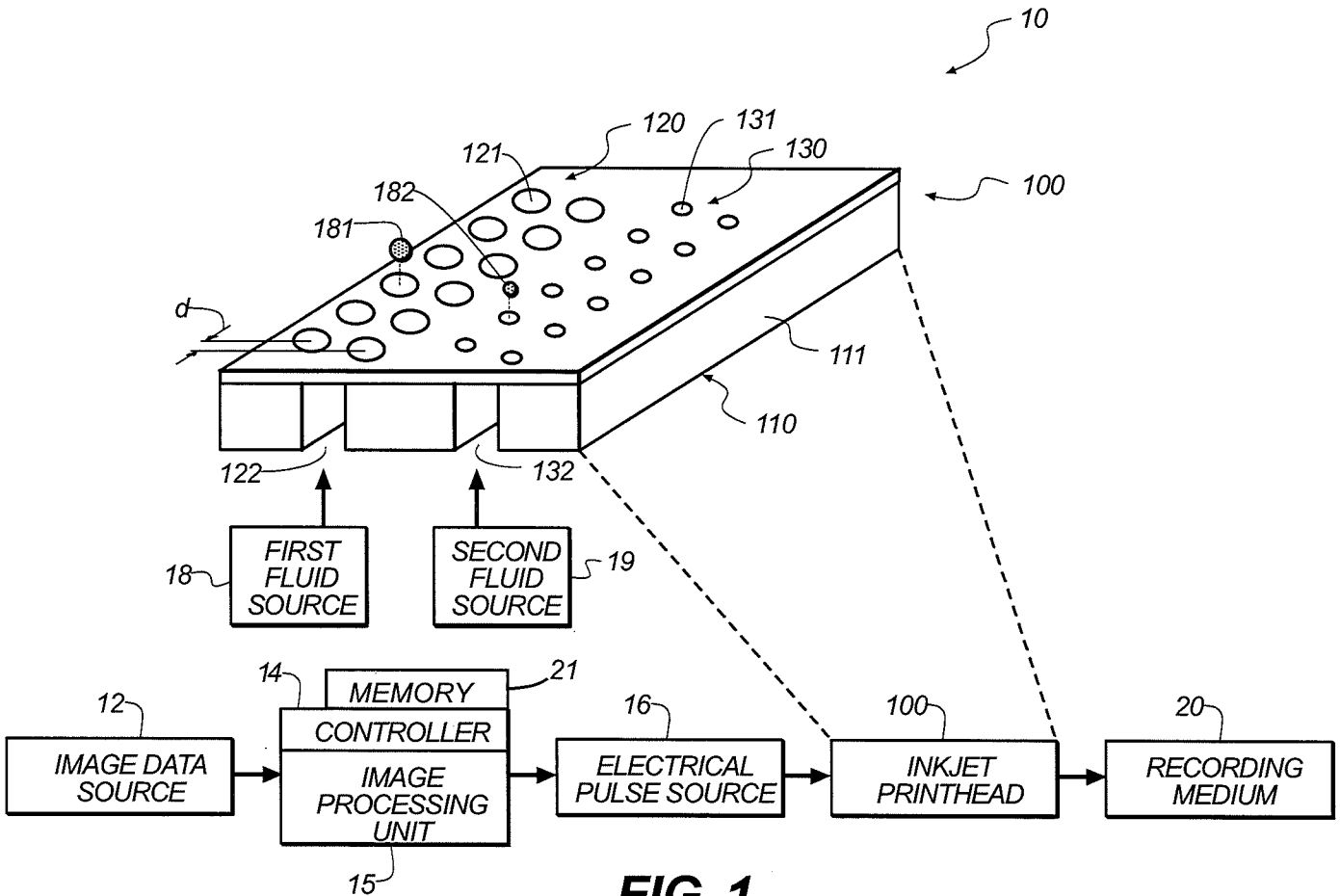
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The inkjet printer system 10 includes an image data source 12, which provides data signals that are interpreted by a controller 14 as being commands to eject drops. The controller 14 includes an image processing unit 15 for rendering images for printing, and outputs signals to an electrical pulse source 16 of electrical energy pulses that are inputted to an inkjet printhead 100, which includes at least one inkjet printhead die 110. The controller 14 also typically includes a memory 21 for storing print data prior to printing.

Figure 2:
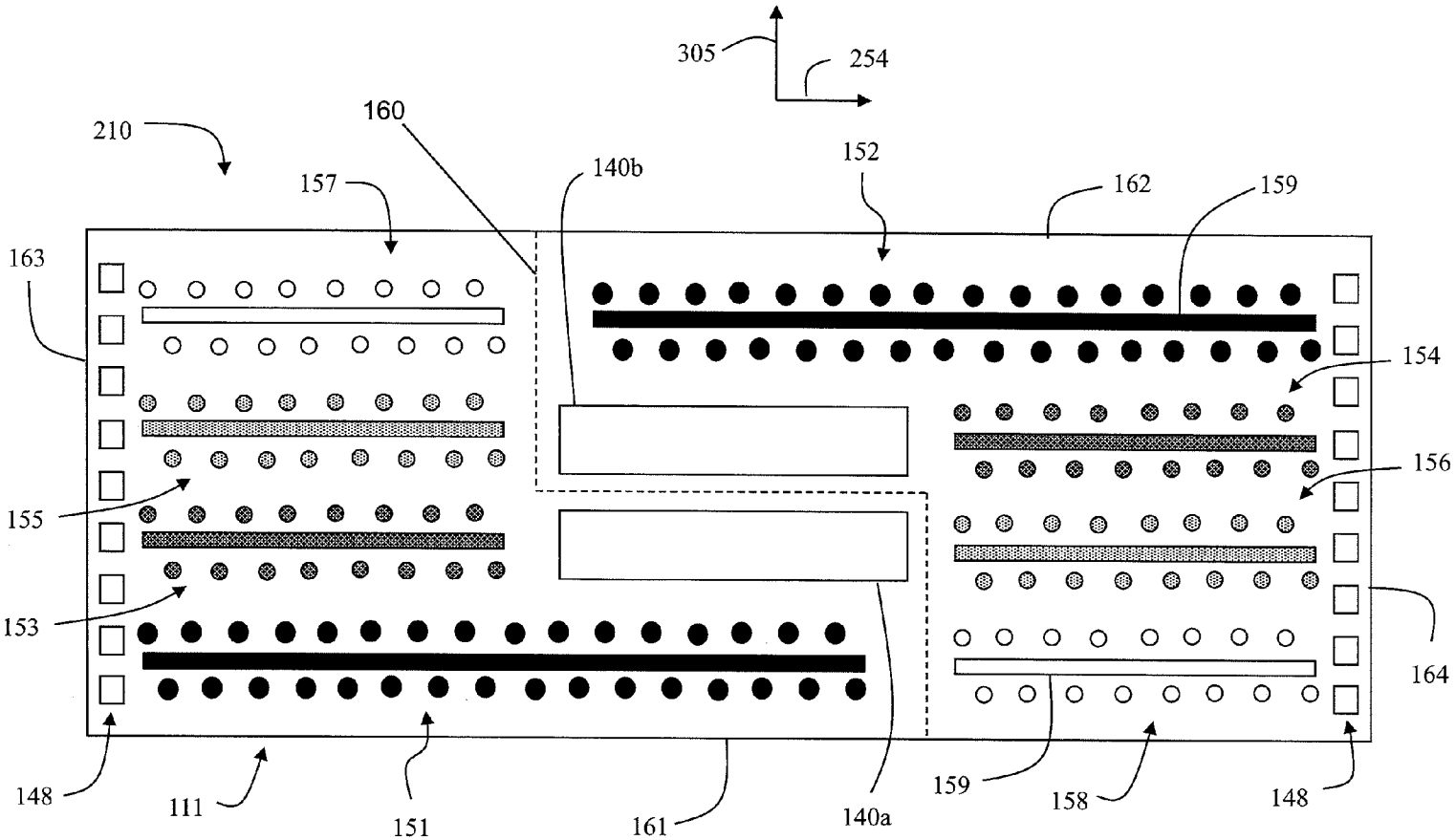
FIG. 2 is a schematic layout of a printhead die including nozzle arrays plus associated electronics according to an embodiment of the invention.

In the example shown in FIG. 1, there are two nozzle arrays 120 and 130 that are each disposed along a nozzle array direction 254 (see FIG. 2). Nozzles 121 in the first nozzle array 120 have a larger opening area than nozzles 131 in the second nozzle array 130. In this example, each of the two nozzle arrays 120 and 130 has two staggered rows of nozzles 121 and 131, each row having a nozzle density of 600 per inch. The effective nozzle density then in each array is 1200 per inch (i.e. d=1/1200 inch in FIG. 1). If pixels on a recording medium 20 were sequentially numbered along the paper advance direction, the nozzles 121, 131 from one row of the nozzle array 120, 130 would print the odd numbered pixels, while the nozzles 121, 131 from the other row of the nozzle array 120, 130 would print the even numbered pixels.

In fluid communication with each nozzle array 120 and 130 is a corresponding ink delivery pathway 122 and 132. The ink delivery pathway 122 is in fluid communication with the first nozzle array 120, and the ink delivery pathway 132 is in fluid communication with the second nozzle array 130. Portions of the ink delivery pathways 122 and 132 are shown in FIG. 1 as openings through printhead die substrate 111. One or more inkjet printhead die 110 will be included in the inkjet printhead 100, but for greater clarity only one inkjet printhead die 110 is shown in FIG. 1. In FIG. 1, a first fluid source 18 supplies ink to the first nozzle array 120 via the ink delivery pathway 122, and second fluid source 19 supplies ink to the second nozzle array 130 via ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132 respectively. Also, in some embodiments, fewer than two or more than two nozzle arrays 120 and 130 can be included on the inkjet printhead die 110. In some embodiments, all nozzles 121 and 131 on the inkjet printhead die 110 can be the same size, rather than having multiple sized nozzles 121 and 131 on the inkjet printhead die 110.

The drop forming mechanisms associated with the nozzles 121, 131 are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets 181 and 182 of ink are deposited on the recording medium 20 (also sometimes called paper, print medium or medium herein).

A printhead die 210 according to an embodiment of the present invention is shown in a schematic printhead die layout of FIG. 2, which is a more detailed embodiment of the inkjet printhead die 110 as in FIG. 1. The printhead die 210 includes a first black nozzle array 151, a second black nozzle array 152, a first cyan nozzle array 153, a second cyan nozzle array 154, a first magenta nozzle array 155, a second magenta nozzle array 156, a first yellow nozzle array 157, and a second yellow nozzle array 158. All of the nozzle arrays 151-158 are disposed along the nozzle array direction 254. The nozzle arrays 151-158 are particular nozzle array layouts similar to nozzle arrays 120 and 130 but with different configurations.

The printhead die 210 having array lengths of a half inch with nozzles at 1200 per inch will have about 600 nozzles per array. For the printhead die 210 that have more than one hundred nozzles, logic electronics 140*a* and 140*b* and driver transistors (not shown, but typically located near the corresponding nozzle arrays) are typically integrated onto the printhead die 210 so that the number of interconnection pads 148 can be reduced. Rather than requiring an interconnection pad 148 for each nozzle in the various nozzle arrays 151-158 in order to power the associated drop forming mechanisms, instead a few inputs, such as serial data, clock, ejector power, logic power, ground, and other control signals are connected to the interconnection pads 148. Electrical input signals, plus power and ground are connected to the logic electronics 140*a* and 140*b* and driver transistors by wiring (not shown) that is patterned on the printhead die 210. Electrical leads (not shown) bring power pulses from the driver transistors to the drop forming mechanisms for the nozzles in the various nozzle arrays 151-158. Also shown in FIG. 2 are ink feed slots 159 that are part of ink delivery pathways such as 122 and 132 (with reference to FIG. 1) for supplying each of the nozzle arrays 151 to 158 with their respective inks.

Figure 3:
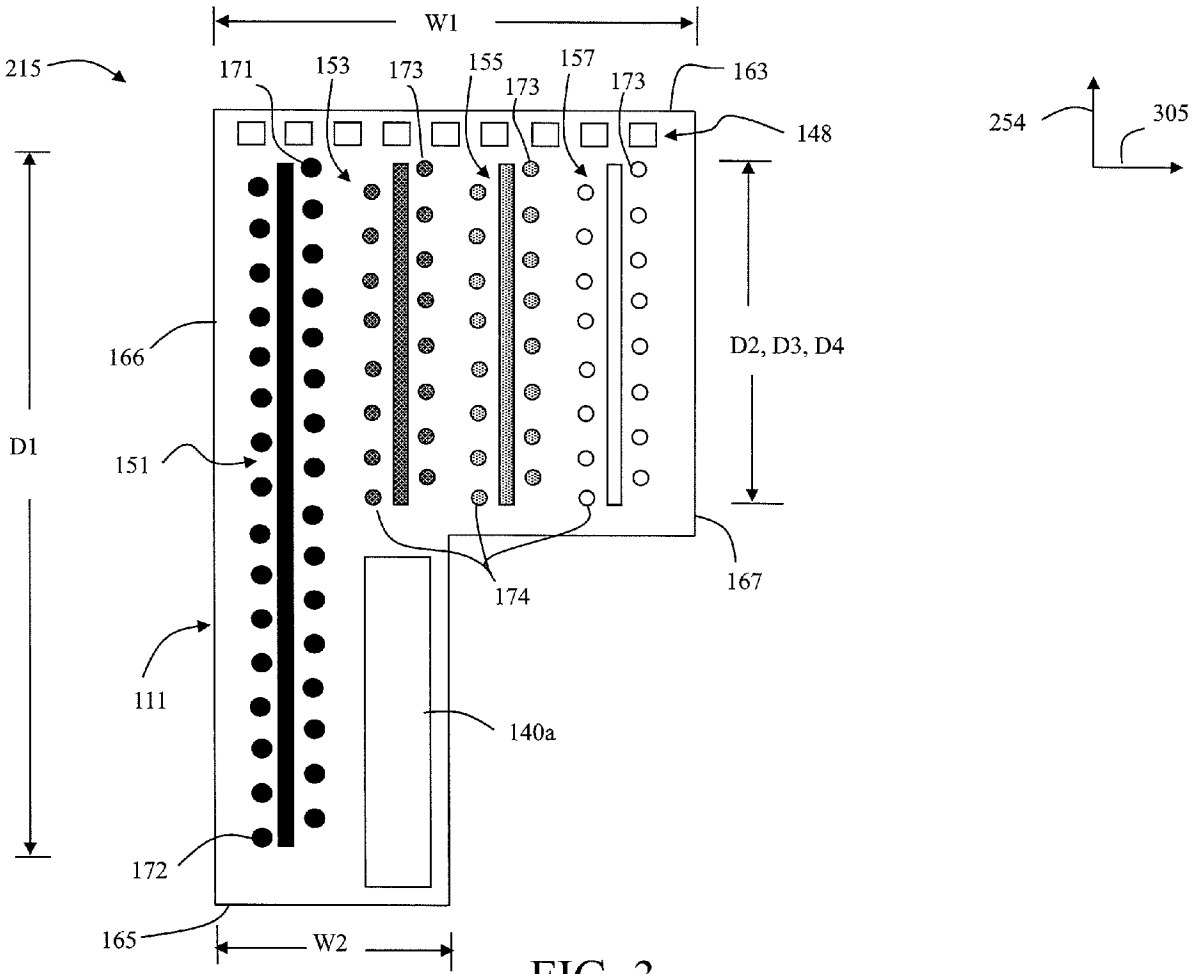
FIG. 3 is schematic layout of a printhead die corresponding to an L-shaped portion of the printhead die shown in FIG. 2.

Broken dashed line 160 separates printhead die 210 into two sections 161 and 162. The section 161 includes the first black nozzle array 151, the first cyan nozzle array 153, the first magenta nozzle array 155, the first yellow nozzle array 157, the die electronics 140*a*, and the group of the interconnection pads 148 located near a first end 163 of the printhead die 210. The nozzle arrays 151, 153, 155 and 157 in the section 161 are separated from each other along a carriage scan direction 305. The section 162 includes the second black nozzle array 152, the second cyan nozzle array 154, the second magenta nozzle array 156, the second yellow nozzle array 158, the die electronics 140*b*, and the group of interconnection pads 148 located near a second end 164 of the printhead die 210. The nozzle arrays 152, 154, 156 and 158 in the section 162 are separated from each other along the carriage scan direction 305. The sections 161 and 162 can be operated independently from each other so that if the wafer singulation step includes separating the section 161 from the section 162 along a broken dashed line 160, two L-shaped printhead die 215 (see FIG. 3) are provided. One such L-shaped printhead die 215 is shown in FIG. 3, where the L-shaped printhead die 215 is the same as the section 161 of the printhead die 210 shown in FIG. 2, but is rotated 90 degrees to orient the carriage scan direction 305 horizontally with respect to the page, as would be the case if the L-shaped printhead die 215 were in a carriage printer. Since the sections 161 and 162 of the printhead die 210 are rotationally symmetric with respect to each other, separating the section 161 from the section 162 provides twice as many L-shaped printhead die 215 as the number of printhead die 210 that would be provided if the sections 161 and 162 were not separated.

With regard to fabrication of the L-shaped printhead die 215, standard wafer dicing is not compatible with providing an L-shaped printhead die. However, U.S. Pat. Nos. 6,521,513 and 8,173,030 disclose die singulation methods including etching that are compatible with providing an L-shaped printhead die 215.

In the examples of the printhead die 210 and the L-shaped printhead die 215 described above, an order of color nozzle arrays was indicated such that the nozzle array closest to the first black nozzle array 151 in the section 161 is the first cyan nozzle array 153. Similarly, in those examples, the nozzle array next closest to the first black nozzle array 151 in the section 161 is the first magenta nozzle array 155, and the nozzle array that is furthest from the first black nozzle array 151 in section 161 is the first yellow nozzle array 157. However, in other examples (not shown) different ink connection arrangements are contemplated such that either a magenta nozzle array is closest to the first black nozzle array 151, or a yellow nozzle array is closest to the first black nozzle array 151. Generically, it is true of both the printhead die 210 (FIG. 2) and the L-shaped printhead die 215 (FIG. 3) that a group of arrays of cyan nozzles, magenta nozzles and yellow nozzles is provided such that the arrays in the group are separated from each other along a scan direction 305, and disposed in an order designated as abc along the scan direction 305 in a first sense, such as left to right in FIG. 3. For the printhead die 210 of FIG. 2, if the group is a first group corresponding to the section 161, the printhead die 210 also includes a second group of cyan nozzles, magenta nozzles and yellow nozzles in the section 162 disposed in an opposite order designated as cba along the scan direction 305 in a second sense opposite the first sense.

With reference to FIG. 3, the configuration of the L-shaped printhead die 215 can be described as follows. The L-shaped printhead die 215 includes the substrate 111 having the first end 163 and the second end 165 opposite the first end. The L-shaped printhead die 215 includes the black nozzle array 151 disposed along the nozzle array direction 254 for ejecting black ink, a first endmost black nozzle 171 of which is near the first end 163 of the substrate 111, and an opposite second endmost nozzle 172 of which is positioned a distance D1 from the first endmost black nozzle 171. The L-shaped printhead die 215 also includes arrays 153, 155 and 157 of color nozzles (i.e. arrays of cyan nozzles, magenta nozzles, and yellow nozzles). It is noted that the arrangement of color arrays can be different that the configuration shown in FIGS. 2 and 3. For example, the magenta array can be closer to the black array rather than being located between the yellow array and cyan array. Each of the color nozzle arrays 153, 155 and 157 is disposed along the nozzle array direction 254 and includes a first endmost color nozzle 173 that is near the first end 163 of the substrate 111 and an opposite second endmost nozzle 174 that is positioned a distance D2 (for cyan), D3 (for magenta) and D4 (for yellow) from the corresponding first endmost color nozzle 173. Typically D2, D3 and D4 are equal to each other or substantially equal to each other, i.e. within 10% of the same lengths. However, D1 is significantly greater (at least 50% greater) than D2, D3 and D4. In FIG. 3, nozzle array 153 is the array of color nozzles that is disposed closest to the array 151 of black nozzles. The logic electronics 140*a* is located between the second end 165 of the substrate 111 and the second endmost nozzle 174 of the color array 153 that is closest to the black nozzle array 151. The description above in this paragraph also applies to the printhead die 210 of FIGS. 2 and 4 if the second end 165 is replaced by the second end 164. Some other geometrical features of L-shaped printhead die 215 of FIG. 3 are different from those of rectangular printhead die 210 of FIGS. 2 and 4. In particular, for the L-shaped printhead die 215 the first end 163 has a first width W1 and the second end 165 has a second width W2 that is equal to or substantially equal to half of W1. In some embodiments for both the printhead die 210 and the L-shaped printhead die 215 it is preferred that D1 is twice as large or approximately twice as large as D2 (i.e. within 10% of twice as large). In such embodiments, for the L-shaped printhead die 215, a first side 166 located near the black nozzle array 151 is equal to or approximately equal to twice the length of the opposite second side 167.

Figure 4:
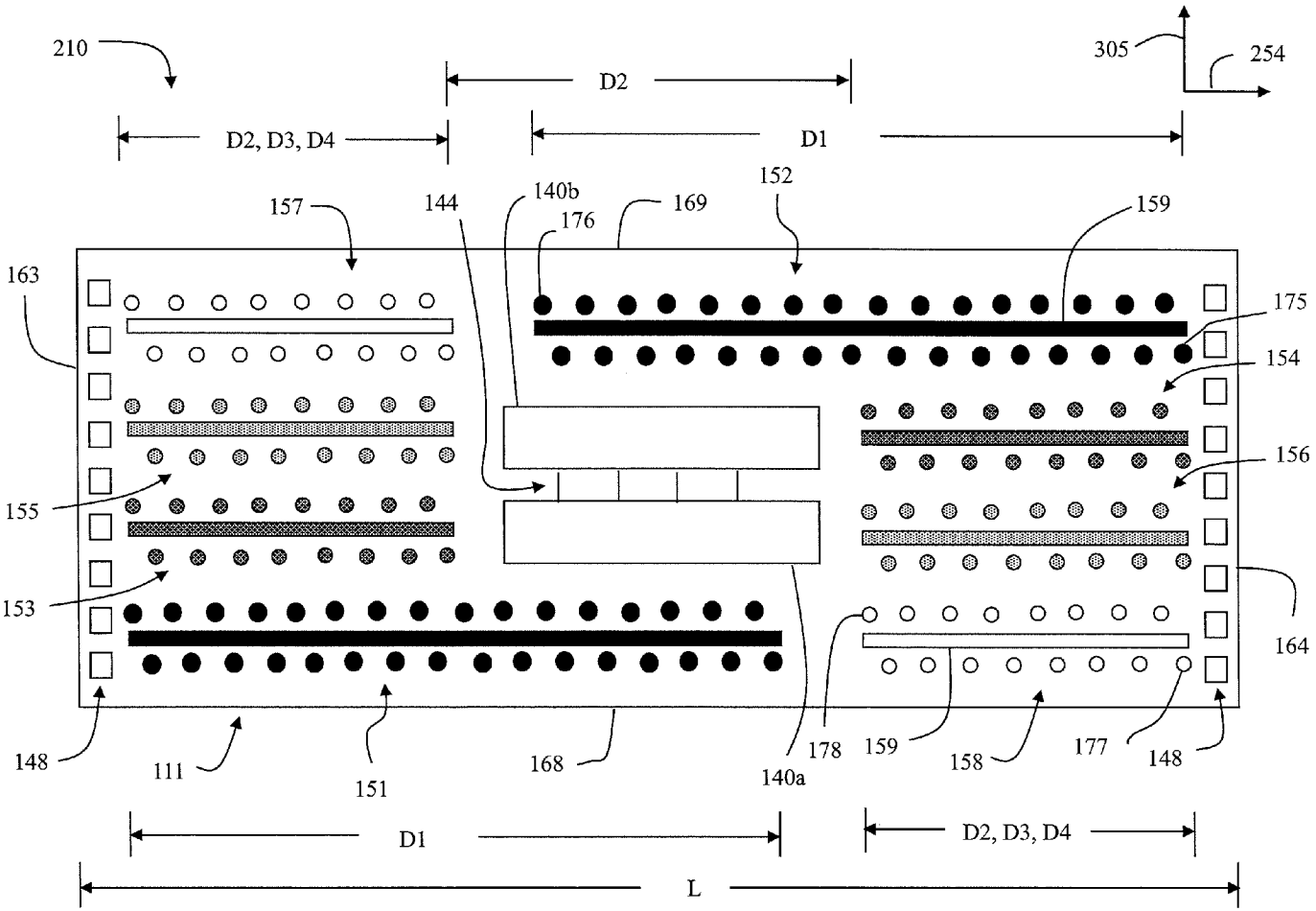
FIG. 4 is a similar view to FIG. 2.

FIG. 4 shows the same view of the printhead die 210 as shown in FIG. 2, but emphasizes a few different details. In addition to the descriptive details indicated in the paragraph above that apply to both the printhead die 210 and the L-shaped printhead die 215, the following details apply to the printhead die 210. The printhead die 210 includes the second black nozzle array 152 disposed along the nozzle array direction 254 for ejecting black ink, a first endmost black nozzle 175 of which is near the second end 164 of the substrate 111, and an opposite second endmost nozzle 176 of which is positioned distance D1 from the first endmost black nozzle 175. The printhead die 210 also includes the second color nozzle arrays 154, 156 and 158 (i.e. arrays of cyan nozzles, magenta nozzles, and yellow nozzles). It is noted that the arrangement of color arrays can be different that the configuration shown in FIGS. 2, 3 and 4. For example, the magenta array can be closer to the black array rather than being located between the yellow array and cyan array. Each of the second color nozzle arrays 154, 156 and 158 is disposed along the nozzle array direction 254 and includes a first endmost color nozzle 177 that is near the second end 164 of the substrate 111 and an opposite second endmost nozzle 178 that is positioned distance D2 (for cyan), D3 (for magenta) and D4 (for yellow) from the corresponding first endmost color nozzle 177. In the printhead die 210, the first black nozzle array 151 is located near a first side 168 and the second black nozzle array 152 is located near an opposite second side 169. The second black nozzle array 152 is disposed in line with or substantially in line with the farthest first color array 157 from the first black nozzle array 151. Similarly, the first black nozzle array 151 is disposed in line with or substantially in line with the farthest first color array 158 from the second black nozzle array 152. The electrical circuitry including logic electronics 140*a* and 140*b* is located between the first black nozzle array 151 and the second black nozzle array 152. Logic electronics 140*a* and 140*b* is also located between the first color nozzle array 153 that is closest to first black nozzle array 151 and the second color nozzle array 154 that is closest to second black nozzle array 152. The substrate 111 has a length L from first end 163 to second end 164. For embodiments where D1 is approximately twice as long as D2, D1 is approximately two thirds as long as L.

A particular configuration of interest is shown in FIG. 4 where D2=D3=D4, and where an offset along the nozzle array direction 254 between the first group of color nozzle arrays 153, 155 and 157 and the second group of color nozzle arrays 154, 156 and 158 is also equal to D2. Printing modes for such a configuration are described below with reference to FIGS. 9 to 12.

The first section of logic circuitry 140*a* that is disposed next to the first black nozzle array 151 typically controls the firing of the first black nozzle arrays 151, as well as the first color nozzle arrays 153, 155 and 157. Similarly, the second section of logic circuitry 140*b* that is disposed next to the second black nozzle array 152 typically controls the firing of the second black nozzle arrays 152, as well as the first color nozzle arrays 154, 156 and 158. Optionally, interconnecting leads 144 can be provided between first section of logic circuitry 140*a* and the second section of logic circuitry 140*b* in the printhead die 210. The interconnecting leads 144 can include a first interconnecting lead to connect power terminals and a second interconnecting lead to connect ground terminals of logic circuitry 140 and 140*b*. In that way, fewer interconnection pads 148 are needed. Similarly a third interconnecting lead 144 can be provided to connect terminals for synchronization of electrical signals. For embodiments where interconnecting leads 144 are removed, the first and second sections of logic circuitry 140*a* and 140*b* operate independently.

Figure 5:
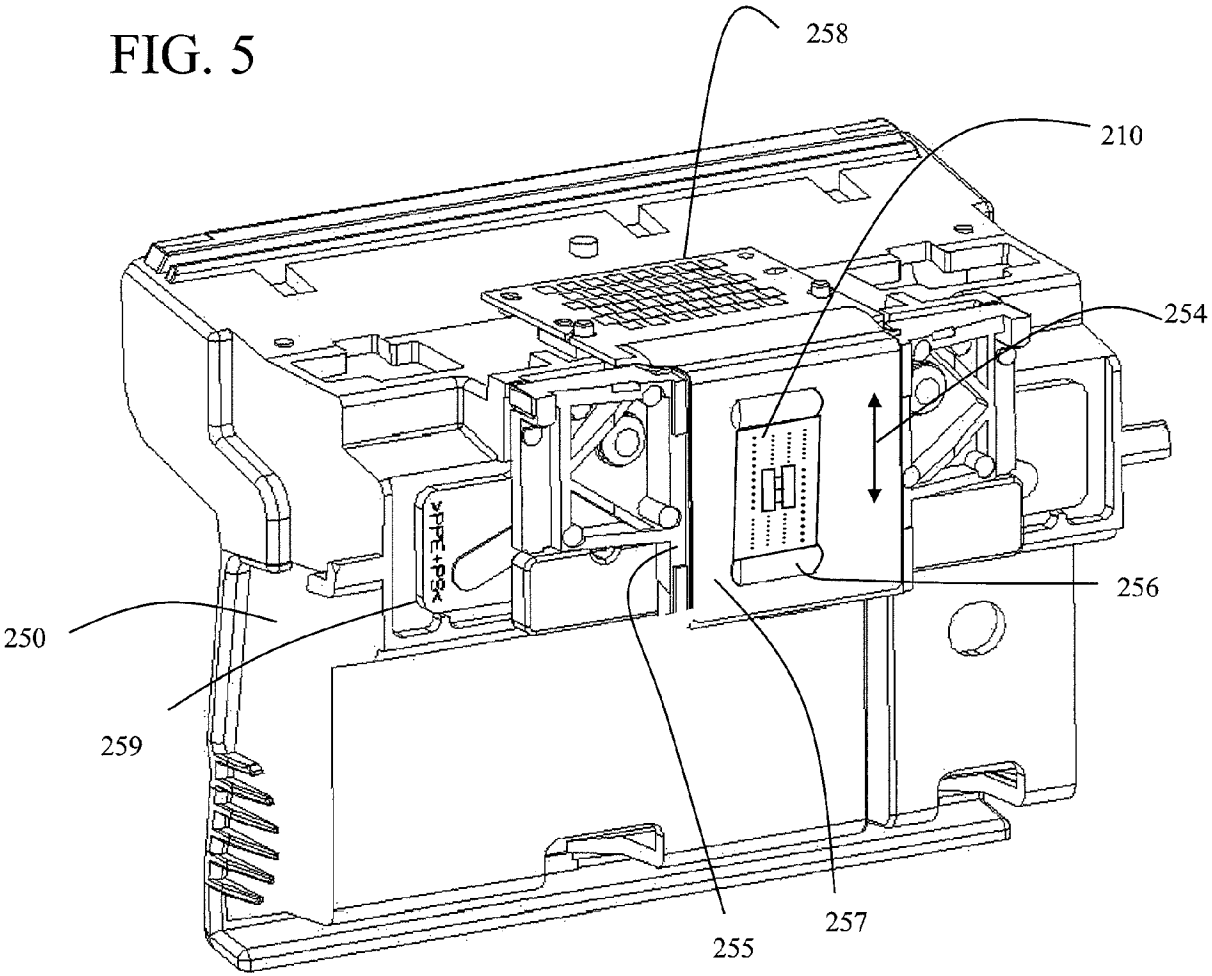
FIG. 5 is a perspective of a portion of a printhead.
Figure 6:
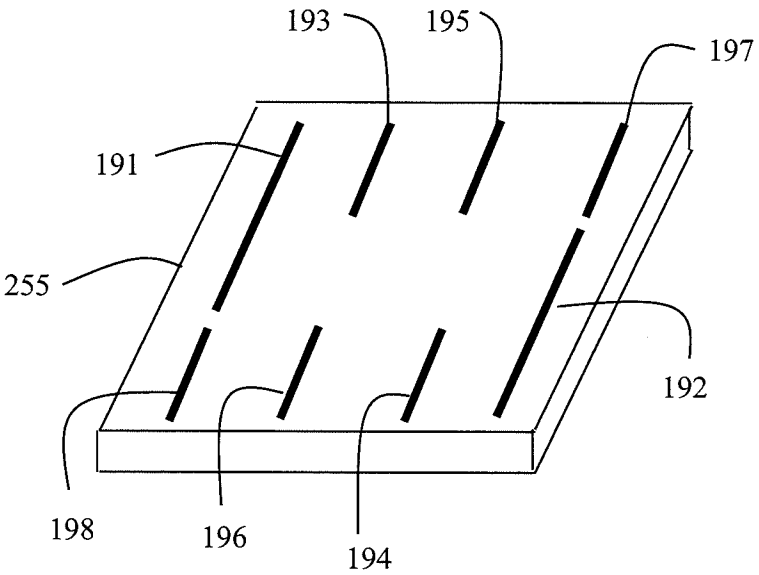
FIG. 6 perspective of a mounting substrate for use with the printhead die of FIG. 2.

FIG. 5 shows a perspective of a portion of a printhead 250, which is an example of an inkjet printhead 100 shown in FIG. 1. The printhead 250 includes the printhead die 210 (as describe above) that is affixed to a mounting support 255. The printhead die 210 includes eight nozzle arrays (two each of cyan, magenta, yellow and black). The eight nozzle arrays in this example can each be connected to separate ink sources (not shown in FIG. 5), via ink passageways (see FIG. 6) in the mounting substrate 255. Referring to FIGS. 5 and 6, in particular ink passageways 191 and 192 in the mounting support 255 are fluidically connected respectively to the first and second black nozzle arrays 151 and 152 of the printhead die 210 when the printhead die 210 is sealingly attached to the mounting support 255 for providing black ink. Similarly, ink passageways 193 and 194 in the mounting support 255 are fluidically connected respectively to the first and second cyan nozzle arrays 153 and 154 for providing cyan ink. Likewise, ink passageways 195 and 196 in mounting support 255 are fluidically connected respectively to the first and second magenta nozzle arrays 155 and 156 for providing magenta ink. Finally; ink passageways 197 and 198 in the mounting support 255 are fluidically connected respectively to the first and second yellow nozzle arrays 157 and 158 for providing yellow ink. Optionally the pairs of ink passageways for the same color inks are joined together at manifold 259 in FIG. 5 so that only one source of each ink color is needed.

Also shown in FIG. 5 is a flex circuit 257 to which the printhead die 210 is electrically interconnected, for example, by wire bonding or TAB bonding. The interconnections and interconnection pads 148 (with reference to FIG. 2) are covered by an encapsulant 256 to protect them. The flex circuit 257 bends around the side of the printhead 250 and connects to a connector board 258. When the printhead 250 is mounted into a carriage 200 (see FIG. 7), the connector board 258 is electrically connected to a connector (not shown) on the carriage 200 so that electrical signals can be transmitted to the printhead die 210.

In a similar way the printhead 250 can include L-shaped printhead die 215 instead of printhead die 210. The mounting substrate 255 for such a printhead would have fewer ink passageways than the one shown in FIG. 6. A printhead including the L-shaped printhead die 215 would not have as high speed printing throughput as a printhead including the printhead die 210, but a printhead including the L-shaped printhead die 215 would be less expensive than a printhead including the printhead die 210.

Figure 7:
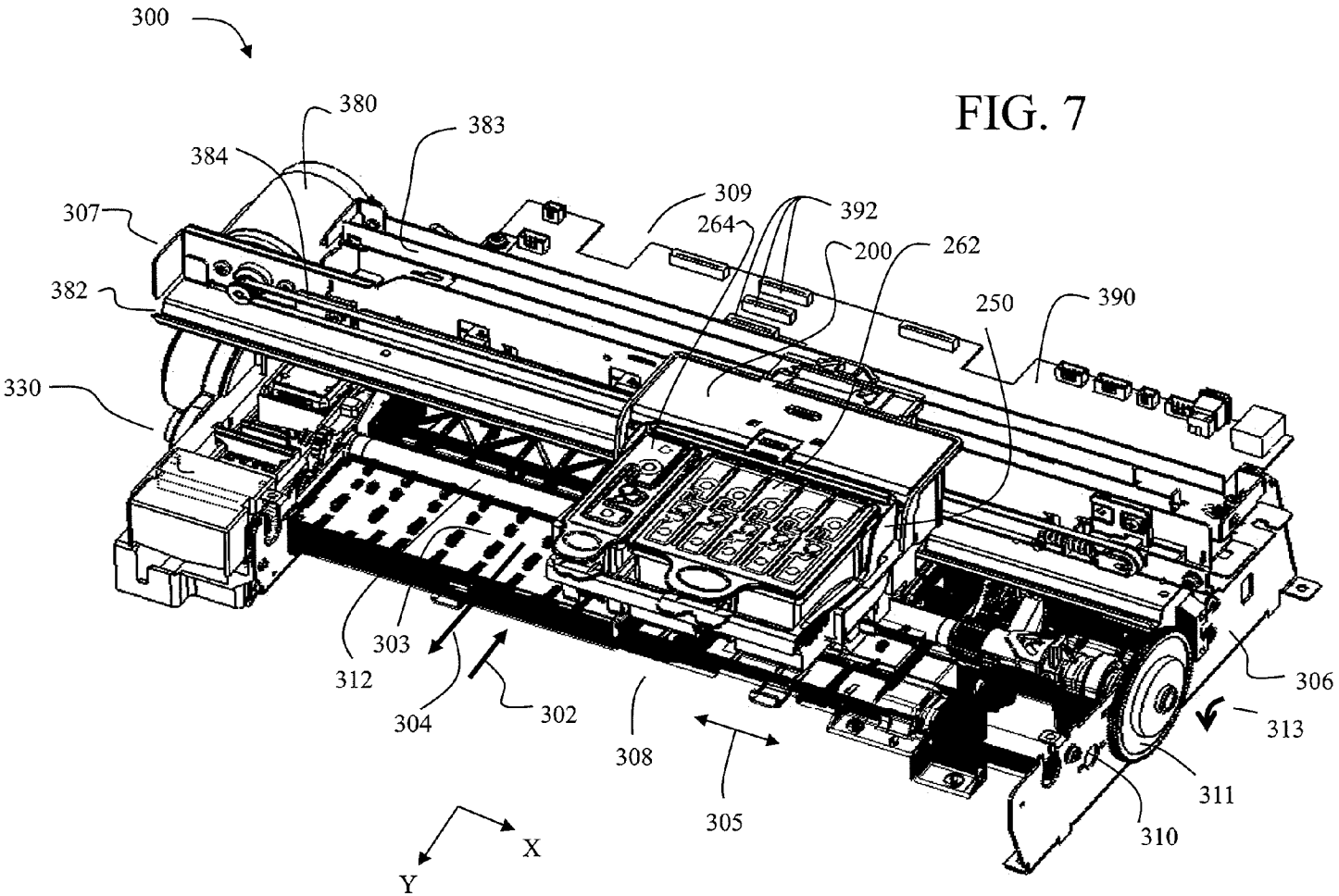
FIG. 7 is a perspective of a portion of a carriage printer.

FIG. 7 shows a portion of a desktop carriage printer. Some of the parts of the printer have been hidden in the view shown in FIG. 7 so that other parts can be more clearly seen. A printer chassis 300 has a print region 303 across which the carriage 200 is moved back and forth in the carriage scan direction 305 along the X axis, between a right side 306 and a left side 307 of the printer chassis 300, while drops are ejected from the printhead die 210 or L-shaped printhead die 215 (not shown in FIG. 7) on the printhead 250 that is mounted on the carriage 200. A carriage motor 380 moves a belt 384 to move the carriage 200 along a carriage guide rail 382. An encoder sensor (not shown) is mounted on the carriage 200 and indicates carriage location relative to an encoder fence 383.

The printhead 250 is mounted in the carriage 200, and a multi-chamber ink supply 262 and single-chamber ink supply 264 are mounted in the printhead 250. The mounting orientation of the printhead 250 is rotated relative to the view in FIG. 5 so that the printhead die 210 or L-shaped printhead die 215 is located at the bottom side of the printhead 250, the droplets of ink being ejected downward onto the recording medium 20 (see FIG. 1) in the print region 303 in the view of FIG. 7. The multi-chamber ink supply 262, for example, contains three ink sources: cyan, magenta, and yellow ink; while the single-chamber ink supply 264 contains the ink source for black. Paper or other recording medium (sometimes generically referred to as paper or media herein) is loaded along the paper load entry direction 302 toward the front of printer chassis 308.

Figure 8:
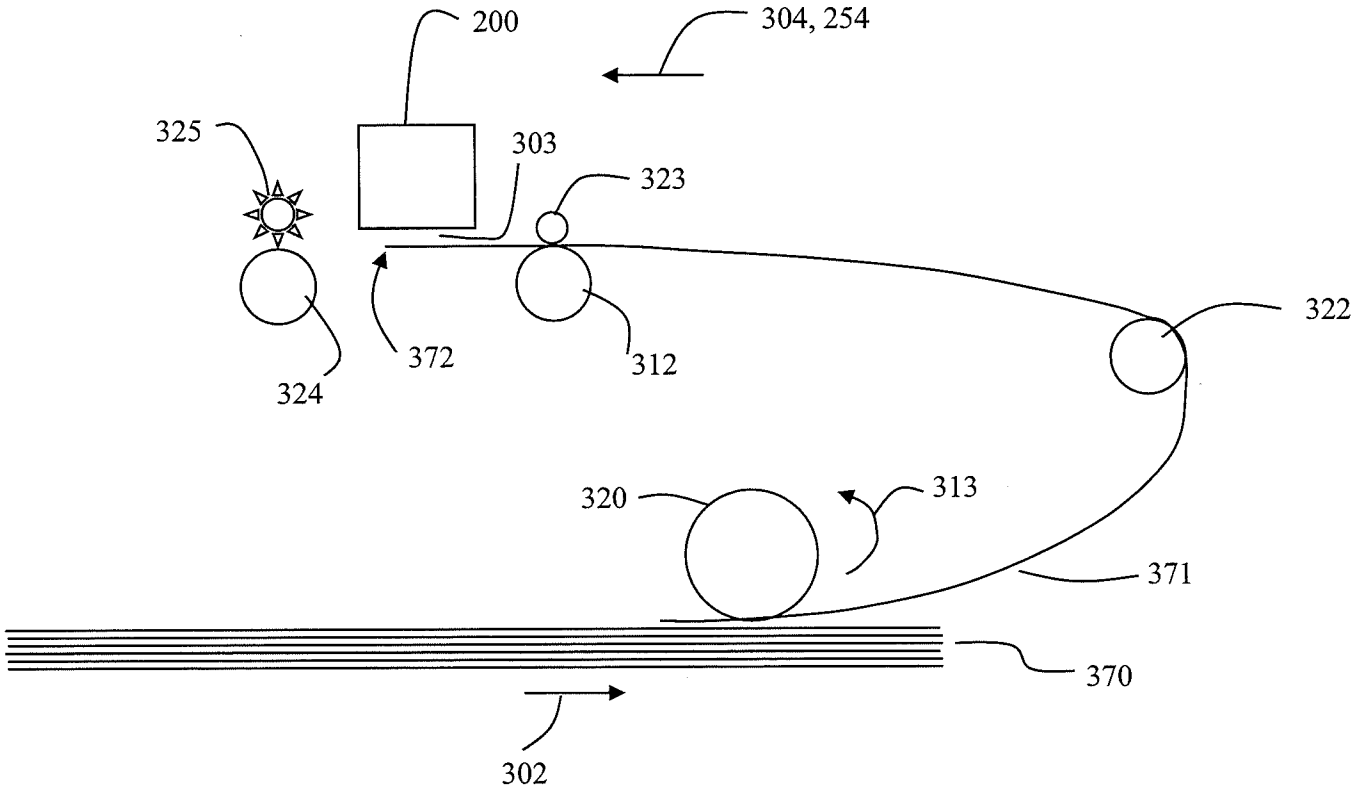
FIG. 8 is a schematic side view of an exemplary paper path in a carriage printer.

Referring to FIG. 8, a variety of rollers is used to advance the medium through the printer. In this example, a pick-up roller 320 moves a top piece or sheet 371 of a stack 370 of paper or other recording medium in the direction of an arrow, a paper load entry direction 302. A turn roller 322 acts to move the paper around a C-shaped path (in cooperation with a curved rear wall surface) so that the paper continues to advance along a media advance direction 304 (which is the same as nozzle array direction 254) from a rear 309 of the printer chassis 300 (with reference also to FIG. 7). The paper is then moved by feed roller 312 and idler roller(s) 323 to advance along the Y axis across the print region 303, and from there to a discharge roller 324 and star wheel(s) 325 so that printed paper exits along the media advance direction 304. In particular in FIG. 8, a lead edge 372 of the sheet 371 has just passed the print region 303. The feed roller 312 includes a feed roller shaft along its axis, and a feed roller gear 311 is mounted on the feed roller shaft. The feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller. The media advance system is defined as any combination of the above described rollers or other paper transport devices such as belts, wheels and the like. It is understood by those skilled in the art that at least one motor will drive the rollers.

The motor that powers the paper advance rollers is not shown in FIG. 7, but a hole 310 at the right side of the printer chassis 306 is where the motor gear (not shown) protrudes through in order to engage the feed roller gear 311, as well as the gear for the discharge roller (not shown). For normal paper pick-up and feeding, it is desired that all rollers rotate in a forward rotation direction 313. Toward the left side of the printer chassis 307, in the example of FIG. 7, is a maintenance station 330.

Toward the rear of the printer chassis 309, in this example, is located an electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Although the L-shaped printhead die 215 of FIG. 3 has an unusual shape, conventional inkjet print modes can be used for printing with it. Taking full advantage of the nozzle array configuration of the printhead die 210 (FIGS. 2 and 4), however, does involve some print modes of the present invention. Described below are single pass and two pass print modes using cyan, magenta and yellow inks and the printhead die 210 having a first group of arrays of cyan nozzles, magenta nozzles and yellow nozzles, the nozzles in each array in the first group being disposed along the nozzle array direction 254 and the arrays being disposed in an order designated as abc along the carriage scan direction 305; and having a second group of arrays of cyan nozzles, magenta nozzles and yellow nozzles displaced from the first group of arrays along the nozzle array direction 254 and disposed in an order designated as cba along the carriage scan direction 305. In order to preserve the same color order from swath to swath, the first group of cyan, magenta and yellow arrays is used for left to right printing passes (for example), and the second group of cyan, magenta and yellow arrays is used for right to left printing passes. For simplicity, printing of black ink will not be described initially because a different color order of black does not cause bi-directional color banding.

Figure 9:
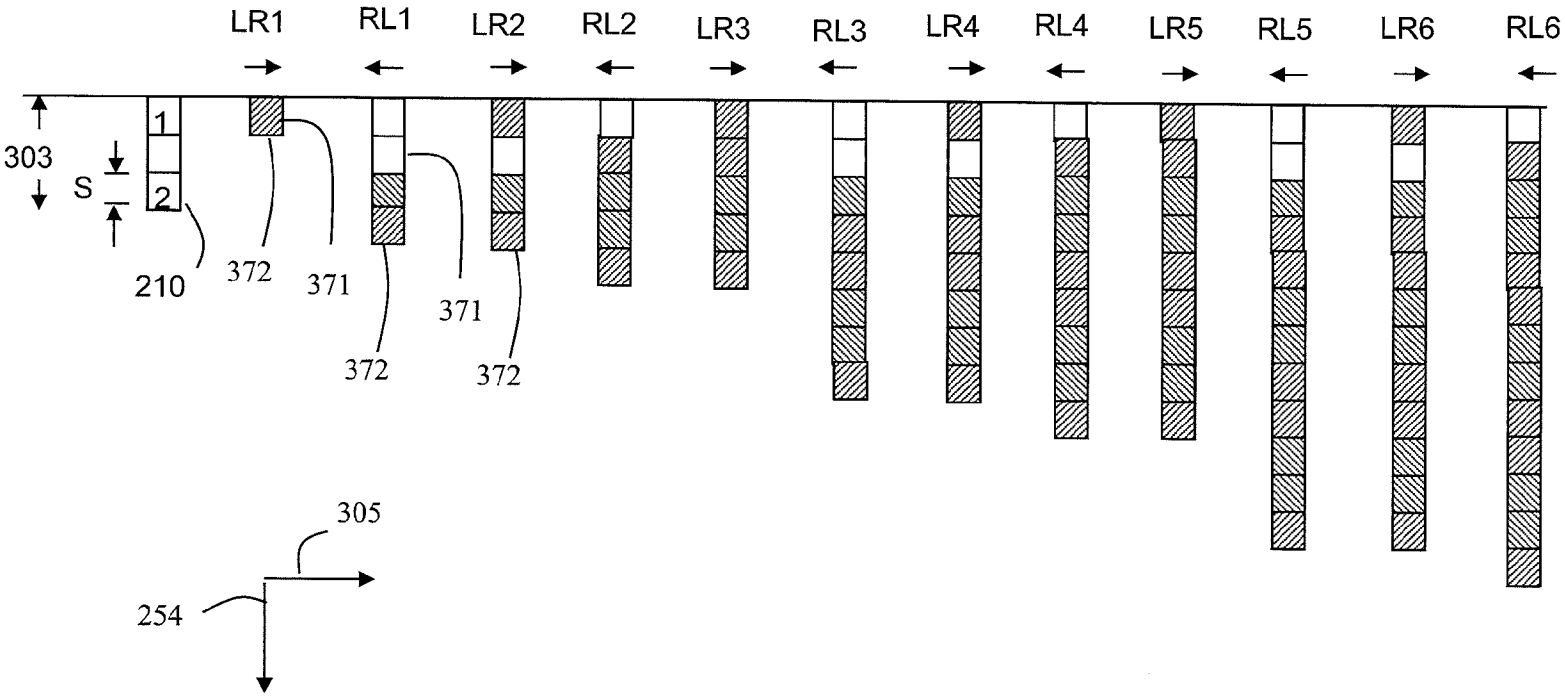
FIG. 9 is a representation of a single pass printing mode using the printhead die of FIG. 2.

FIG. 9 represents single pass printing using the printhead 250 having the printhead die 210 as shown in FIG. 4, where the first group of color nozzle arrays (designated as 1) has an array length S=D2, the second group of color nozzle arrays (designated as 2) has an array length S=D2, and an offset between the first group of color arrays and the second group of color arrays is equal to the array length S=D2. The printhead die 210 is represented as three boxes of equal height, where the center box (having no number) represents the offset region where there are no nozzles from either the first group or the second group of color nozzles. To the right of the printhead die 210 are twelve sequential bi-directional single pass printing passes according to an embodiment of the invention. In the convention of FIG. 9, all portions of the sheet 371 printed by first group of color arrays 1 are indicated as hatched with diagonal lines slanting downward right to left, and all portions of the sheet 371 printed by a second group of color arrays 2 are indicated as hatched with diagonal lines slanting downward left to right. In the example of FIG. 9, the sheet 371 of print medium is advanced along the nozzle array direction 254 until the lead edge 372 is near the bottom of first group of color arrays 1. In other words a first portion of the sheet 371 represented by a box of array length S is aligned with the first group of color arrays 1. The sheet 371 is then stopped. The carriage 200 (FIG. 7) then makes a first left to right printing pass LR1 moving the printhead 250 along the carriage scan direction 305 while a first portion of the sheet 371 (indicated at LR1 as hatched with diagonal lines slanting downward right to left) is printed with first group of color arrays 1. The sheet 371 is then advanced along the nozzle array direction 254 by a distance of three array lengths (3S). This is represented at RL1 by the lead edge 372 being three boxes of array length S farther down relative to the printhead die 210. The sheet 371 is stopped when a second portion of the sheet 371 represented by the box just above the bottom box (previously printed during LR1) is aligned with the second group of color arrays 2. The carriage 200 (FIG. 7) then makes a first right to left printing pass RL1 moving the printhead 250 along the carriage scan direction 305 while the second portion of the sheet (indicated at RL1 as hatched with diagonal lines slanting downward left to right) is printed with the second group of color arrays 2. Following the first right to left pass RL1, there is no advance of the sheet 371 prior to a second left to right pass LR2. This can be seen in FIG. 9 by noting that the lead edge 372 is at the same place for LR2 as it was for RL1. During printing pass LR2, a portion of the sheet 371 aligned with the first group of color arrays 1 is printed as the carriage 200 moves left to right. In fact, for all left to right passes (LR) printing is done on a portion of the sheet 371 of swath height S that is aligned with first group of color arrays 1. After printing pass LR2, the sheet 371 is advanced by S, so that the portion of the sheet 371 represented by the white box at LR2 is now aligned with second group of color arrays 2. During printing pass RL2, the portion of the sheet 371 aligned with the second group of color arrays 2 is printed as the carriage 200 moves right to left. In fact, for all right to left passes (RL) printing is done on a portion of the sheet 371 of swath height S that is aligned with second group of color arrays 2. Between a given right to left pass and the next left to right pass, there is no advance of the sheet 371. Between a given left to right pass and the next right to left pass, there is alternatingly an advance of the sheet 371 by S or by 3S. Although the hatching of the different boxes representing different portions of the sheet 371 is different to indicate whether those portions were printed by the first group of color arrays 1 or the second group of color arrays 2, the color order is always the same for the entire printed sheet 371. This is because the order of color arrays in the first group of color arrays 1 (such as CMY) is opposite the order of color arrays in the second group of color arrays 2 (such as YMC), and the first group of color arrays 1 is only used to print left to right while the second group of color arrays 2 is only used to print right to left in the example of FIG. 9. The controller 14 and the image processing unit 15 (FIG. 1) designate pixel locations along a swath of the image according to whether they are to be printed using the first group of color arrays 1 or the second group of color arrays 2. In a single pass printing mode, such as shown in FIG. 9, all cyan, magenta and yellow pixels in a first swath of height S are designated to be printed using the first group of color arrays 1, and all cyan, magenta and yellow pixels in a second swath of height S are designated to be printed using the second group of color arrays 2.

Figure 10:
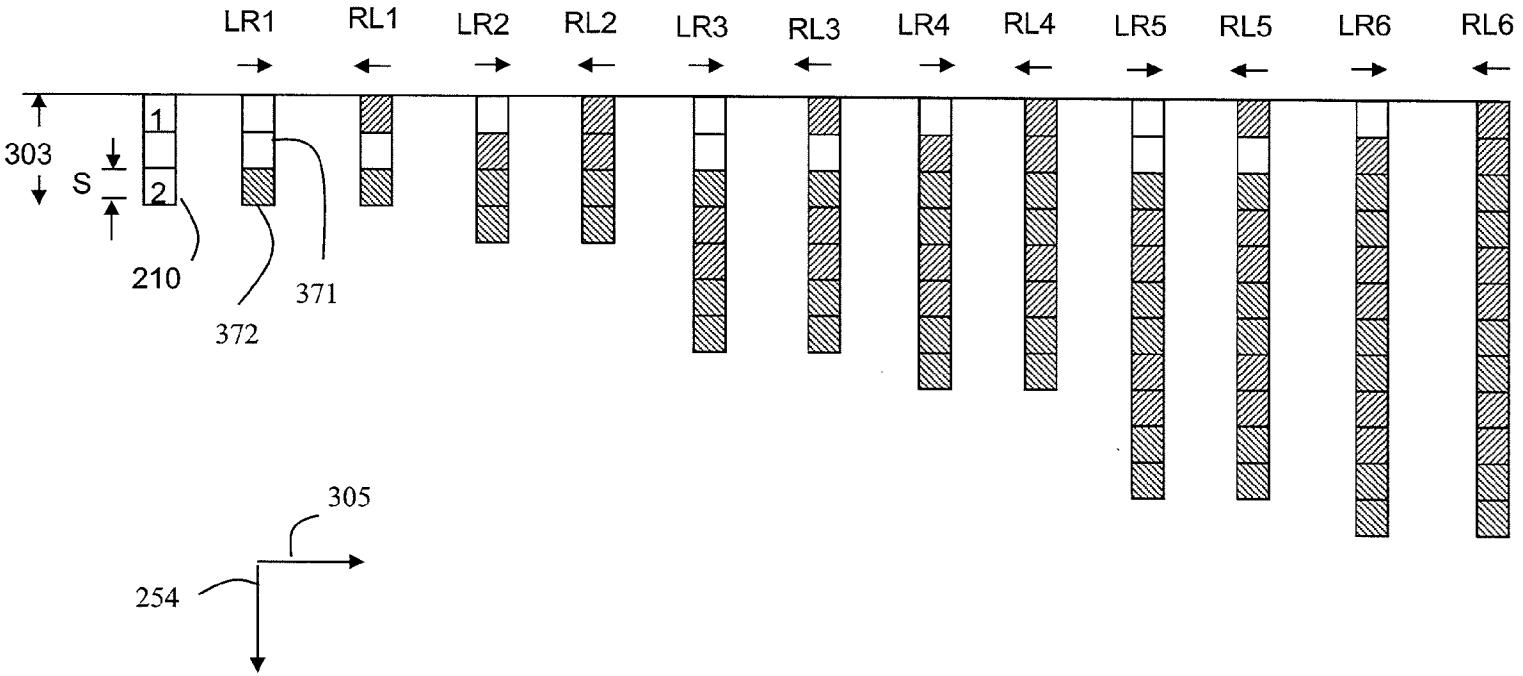
FIG. 10 is a representation of another single pass printing mode using the printhead die of FIG. 2.

The example of FIG. 9 showed all left to right passes being printed by the first group of color arrays 1 and all right to left passes being printed by the second group of color arrays 2. FIG. 10 shows an example of single pass printing where all left to right passes are printed by the second group of color arrays 2 and all right to left passes are printed by the first group of color arrays 1. The sheet 371 of print medium is advanced along the nozzle array direction 254 until the lead edge 372 is near the bottom of the second group of color arrays 2. The carriage 200 (FIG. 7) then makes a first left to right printing pass LR1 along the carriage scan direction 305 while a first portion of the sheet 371 (indicated at LR1) as hatched with diagonal lines slanting downward left to right is printed by the second group of color arrays 2. (Hatching conventions are the same in FIG. 10 as in FIG. 9.) The sheet 371 is not advanced prior to first right to left pass RL1 in which a portion aligned with the first group of color arrays 1 is printed. After the first right to left pass RL1, the sheet 371 is advanced by S and a portion of the sheet 371 aligned with the second group of color arrays 2 is printed. Similar to the example shown in FIG. 9, the sheet 371 is alternatingly advanced by S or by 3S, but in the example of FIG. 10, the advances occur after the RL passes rather than after the LR passes.

While single pass printing (as described above relative to FIGS. 9 and 10) has the advantage of fast printing throughput, multipass printing can have an advantage of improved print quality by disguising the effects of misdirected or missing jets for example. In multipass printing, responsibility for printing each raster line of the image is shared between a plurality of dot forming elements. In this way the nonuniform marking behavior of dot forming elements can be disguised in order to provide improved image quality. For an inkjet printer, multipass printing can provide time for improving the uniformity of ink-media interactions by controlling the pattern of dots that can be printed within one pass, thereby reducing coalescence (i.e. flowing together of ink drops on the surface of the page before they soak into the page). Multipass printing can also enable multitone printing in which multiple dots of a same color are printed in the same pixel location.

Figure 11:
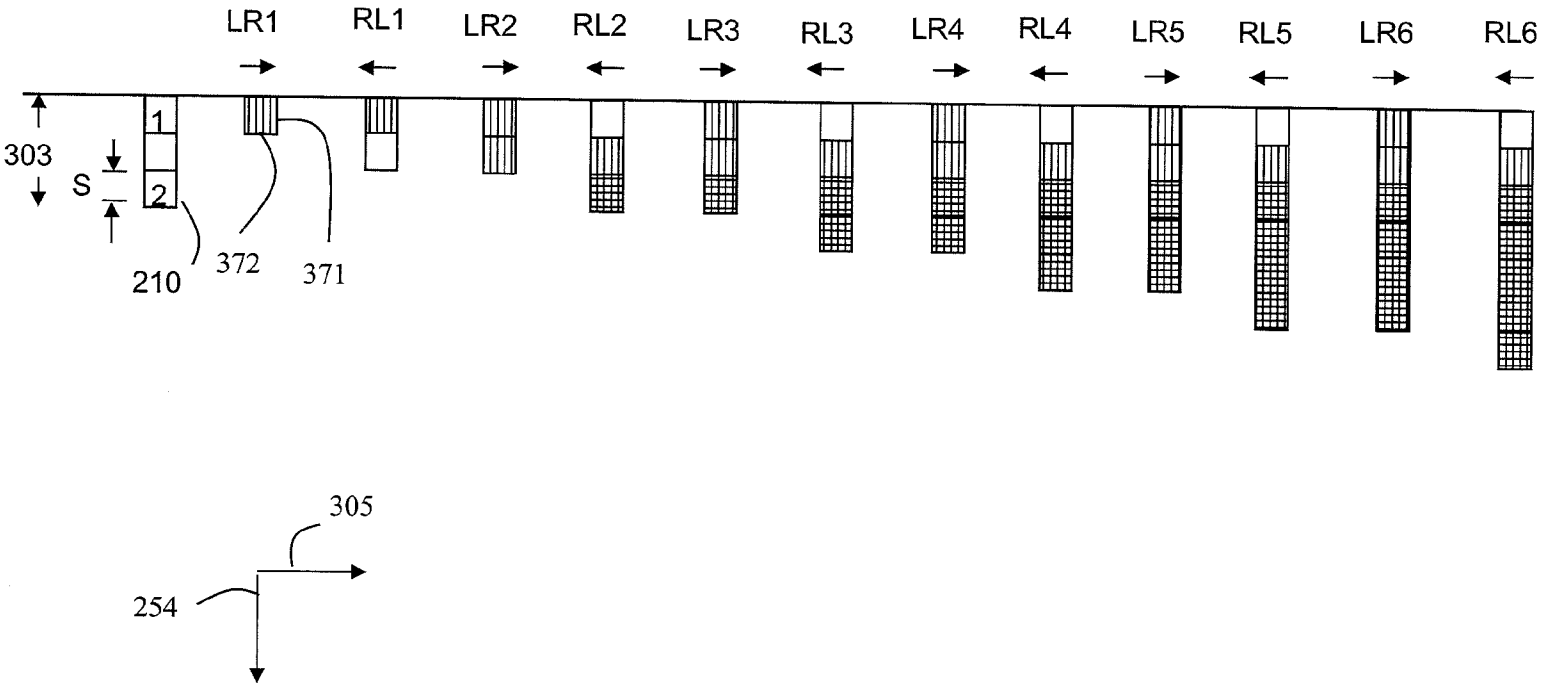
FIG. 11 is a representation of a two pass printing mode using the printhead die of FIG. 2.
Figure 12:
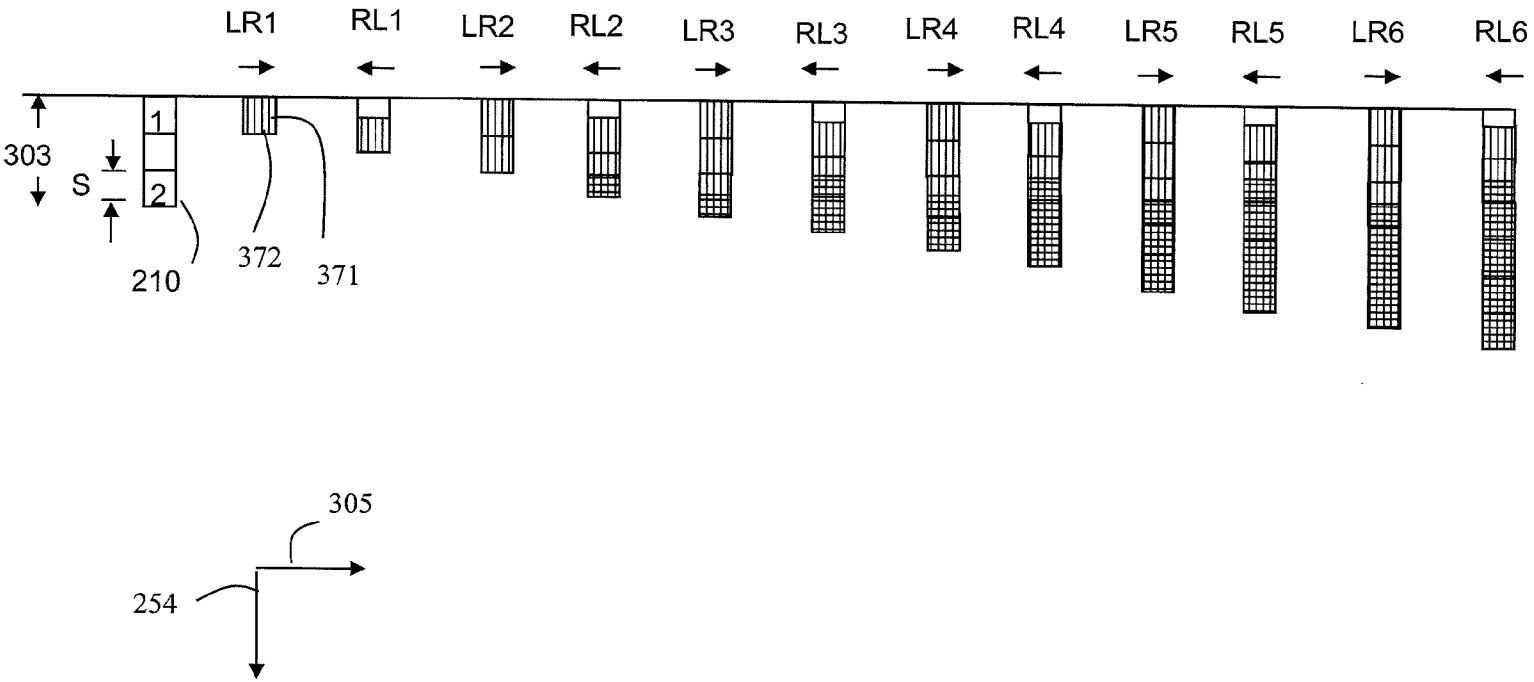
FIG. 12 is a representation of another two pass printing mode using the printhead die of FIG. 2.

Examples of two-pass printing are described below with reference to FIGS. 11 and 12 using the printhead 250 having the printhead die 210 having the first group of color arrays 1 and the second group of color arrays 2 where the second group of color arrays 2 is offset from the first group of color arrays 1 along the nozzle array direction 254. The different color arrays are arranged in opposite order for the second group of color arrays 2 relative to the first group of nozzle arrays 1. In multipass printing, the controller 14 and the image processing unit 15 (FIG. 1) designate a first set of cyan, magenta and yellow pixel locations in a first swath of height S to be printed using the first group of color arrays 1 and designate a second set of cyan, magenta and yellow pixel locations in the first swath of height S to be printed using the second group of color arrays 2. In two pass printing the second set of pixel locations is complementary to the first set, so that in two passes of printing all pixel locations can be printed. In the examples of FIG. 11 and FIG. 12 the hatching convention used is that vertical line hatching indicates a first pass of a portion of pixel locations in a swath has been printed by the first group of color arrays 1. Cross hatching represents portions of the paper where a complementary set of pixel locations have also been printed in an opposite direction by the second group of color arrays 2. In FIG. 11 the sheet 371 is advanced by S after each LR pass but is not advanced after each RL pass. In FIG. 12 the sheet 371 is advanced by S/2 after each RL pass and after each LR pass. In both examples, as is true for single pass printing, the sheet 371 is advanced along the nozzle array direction 254 and is stopped such that a first portion of the sheet 371 is proximate the first group of color arrays 1. The carriage 200 then moves the printhead 250 in a first sense along the carriage scan direction 305 while printing on the first portion of the sheet 371 using the first group of color arrays 1. The sheet 371 is then advanced along the nozzle array direction 254 and is stopped such that a second portion of the sheet 371 is proximate the second group of color arrays 2. The carriage 200 then moves the printhead 250 in a second sense opposite the first sense along the carriage scan direction 305 while printing on the first portion of the sheet 371 using the second group of color arrays 2. The steps are repeated a plurality of times. In two pass printing the sheet 371 is also stopped such that the first portion is proximate the second group of color arrays 2 so that the first portion can also be printed by the second group of color arrays 2 while the carriage 200 moves the printhead 250 in the second sense that is opposite the first sense. In the examples shown in FIGS. 11 and 12 first group of color arrays 1 only prints while the printhead 250 moves in a left to right direction, and the second group of color arrays 2 only prints while the printhead 250 moves in a right to left direction. Since the color arrays in the second group of color arrays 2 are arranged in opposite order as color arrays in the first group of color arrays 1, color laydown order is preserved throughout the print.

Most prints do not have only cyan, magenta and yellow dots, but also have black dots. Some documents are printed with black only, and other documents are printed with both black and color dots, for example in a first portion and other portions of the sheet 371. The printhead die 210 also includes the first black nozzle array 151 and the second black nozzle array 152 as described above relative to FIG. 2. Unlike the first group of color nozzles 1 and the second group of color nozzles 2 that have an offset between them having no color nozzles, the first black nozzle array 151 and the second black nozzle array 152 overlap each other, such that toward the central portion of the printhead die 210 there are two groups of black nozzles, while at each end there is only one group of black nozzles. The second black nozzle array 152 is displaced from the first black nozzle array 151 along both the nozzle array direction 254 and the carriage scan direction 305. The controller 14 and the image processing unit 15 designate pixel locations along a swath of an image to be printed according to whether they are to be printed using the first black nozzle array 151 or the second black nozzle array 152. Typically the array length H=D1 of the first black nozzle array 151 is equal to the array length of the second black nozzle array 152. In some single pass print modes all black pixel locations in a first swath of height equal to array length H are designated to be printed using only the first black nozzle array 151, and all black pixel locations in a second swath of height equal to array length H are designated to be printed using only the second black nozzle array 152. In some multipass print modes a first set of black pixel locations in a first swath of height equal to array length H are designated to be printed using the first black nozzle array 151, and a second set of black pixel locations in the first swath are printed using the second black nozzle array 152. Documents that only contain black pixel locations and no color pixel locations can be printed at faster printing throughput than documents containing color pixel locations as well. This is because the array length H=D1 of the first and second black nozzle arrays 151 and 152 is greater than the array length S=D2 of the first group of the color arrays 153, 155 and 157 and the second group of the color arrays 154, 156 and 158. Thus, for printing of swaths containing color pixels (see FIGS. 9-12) the sheet 371 is advanced a distance A (which can depend on print mode as well as which printing pass). For swaths including only black pixels, the sheet 371 can be advanced by a distance greater than A, thereby increasing printing throughput.

The present invention has been described in detail with particular reference to certain preferred embodiments thereof, but it will be understood that variations and modifications can be effected within the spirit and scope of the invention.

PARTS LIST

| | |
|---|---|
| 1 | First group of color arrays |
| 2 | Second group of color arrays |
| 10 | Inkjet printer system |
| 12 | Image data source |
| 14 | Controller |
| 15 | Image processing unit |
| 16 | Electrical pulse source |
| 18 | First fluid source |
| 19 | Second fluid source |
| 20 | Recording medium |
| 21 | Memory |
| 100 | Inkjet printhead |
| 110 | Inkjet printhead die |
| 111 | Substrate |
| 120 | First nozzle array |
| 121 | Nozzle(s) |
| 122 | Ink delivery pathway (for first nozzle array) |
| 130 | Second nozzle array |
| 131 | Nozzle(s) |
| 132 | Ink delivery pathway (for second nozzle array) |
| 140a | Logic electronics |
| 140b | Logic electronics |
| 144 | Interconnecting leads |
| 148 | Interconnection pads |
| 151 | First black nozzle array |
| 152 | Second black nozzle array |
| 153 | First cyan nozzle array |
| 154 | Second cyan nozzle array |
| 155 | First magenta nozzle array |
| 156 | Second magenta nozzle array |
| 157 | First yellow nozzle array |
| 158 | Second yellow nozzle array |
| 159 | Ink feed slot(s) |
| 160 | Broken dashed line |
| 161 | Section (of printhead die) |
| 162 | Section (of printhead die) |
| 163 | First end (of printhead die) |
| 164 | Second end (of printhead die 210) |
| 165 | Second end (of printhead die 215) |
| 166 | First side (of printhead die 215) |
| 167 | Second side (of printhead die 215) |
| 168 | First side |
| 169 | Second side |
| 171 | First endmost nozzle (of first black nozzle array) |
| 172 | Second endmost nozzle (of first black nozzle array) |
| 173 | First endmost nozzle (of first color nozzle array) |
| 174 | Second endmost nozzle (of first color nozzle array) |
| 175 | First endmost nozzle (of second black nozzle array) |
| 176 | Second endmost nozzle (of second black nozzle array) |

-continued

PARTS LIST

| | |
|---|---|
| 177 | First endmost nozzle (of second color nozzle array) |
| 178 | Second endmost nozzle (of second color nozzle array) |
| 181 | Droplet(s) (ejected from first nozzle array) |
| 182 | Droplet(s) (ejected from second nozzle array) |
| 191 | First ink passageway for black |
| 192 | Second ink passageway for black |
| 193 | First ink passageway for cyan |
| 194 | Second ink passageway for cyan |
| 195 | First ink passageway for magenta |
| 196 | Second ink passageway for magenta |
| 197 | First ink passageway for yellow |
| 198 | Second ink passageway for yellow |
| 200 | Carriage |
| 210 | Printhead die |
| 215 | Printhead die |
| 250 | Printhead |
| 254 | Nozzle array direction |
| 255 | Mounting support |
| 256 | Encapsulant |
| 257 | Flex circuit |
| 258 | Connector board |
| 259 | Manifold |
| 262 | Multi-chamber ink supply |
| 264 | Single-chamber ink supply |
| 300 | Printer chassis |
| 302 | Paper load entry direction |
| 303 | Print region |
| 304 | Media advance direction |
| 305 | Carriage scan direction |
| 306 | Right side of printer chassis |
| 307 | Left side of printer chassis |
| 308 | Front of printer chassis |
| 309 | Rear of printer chassis |
| 310 | Hole (for paper advance motor drive gear) |
| 311 | Feed roller gear |
| 312 | Feed roller |
| 313 | Forward rotation direction (of feed roller) |
| 320 | Pick-up roller |
| 322 | Turn roller |
| 323 | Idler roller |
| 324 | Discharge roller |
| 325 | Star wheel(s) |
| 330 | Maintenance station |
| 370 | Stack of media |
| 371 | Sheet |
| 372 | Lead edge |
| 380 | Carriage motor |
| 382 | Carriage guide rail |
| 383 | Encoder fence |
| 384 | Belt |
| 390 | Printer electronics board |
| 392 | Cable connectors |

The invention claimed is:

1. An inkjet printhead die comprising:

a substrate having a first end and a second end opposite the first end;

an array of black nozzles disposed along an array direction for ejecting black ink, a first endmost black nozzle of which is disposed proximate the first end of the substrate, and an opposite second endmost black nozzle of which is disposed a distance D1 from the first endmost black nozzle;

an array of cyan nozzles for ejecting cyan ink, a first endmost nozzle of which is disposed proximate the first end of the substrate, and an opposite second endmost nozzle of which is disposed a distance D2 from the first endmost cyan nozzle;

an array of magenta nozzles for ejecting magenta ink, a first endmost nozzle of which is disposed proximate the first end of the substrate, and an opposite second endmost nozzle of which is disposed a distance D3 from the first endmost nozzle; and an array of yellow nozzles for ejecting yellow ink, a first endmost nozzle of which is disposed proximate the first end of the substrate, and an opposite second endmost nozzle of which is disposed a distance D4 from the first endmost nozzle, wherein D2, D3 and D4 are equal to or substantially equal to each other, and wherein D1 is greater than D2; wherein the first end of the substrate has a first width, and the second end of the substrate has a second width that is equal to or substantially equal to half the first width.

2. The inkjet printhead die of claim 1, wherein one of the arrays of cyan nozzles, magenta nozzles or yellow nozzles is disposed closest to the array of black nozzles, the inkjet printhead die further comprising electrical circuitry disposed between the second endmost nozzle of the array disposed closest to the array of black nozzles and the second end of the substrate.

3. The inkjet printhead die of claim 1, wherein D1 is twice as large or approximately twice as large as D2.

4. The inkjet printhead die of claim 3, wherein the substrate has a first side having a first length, the array of black nozzles being proximate the first side, and a second side having a second length, the second side being opposite the first side, and wherein the first length is equal to or substantially equal to twice the second length.

5. An inkjet printhead die comprising:

a substrate having a first end and a second end opposite the first end;

an array of black nozzles disposed along an array direction for ejecting black ink, a first endmost black nozzle of which is disposed proximate the first end of the substrate, and an opposite second endmost black nozzle of which is disposed a distance D1 from the first endmost black nozzle;

an array of cyan nozzles for ejecting cyan ink, a first endmost nozzle of which is disposed proximate the first end of the substrate, and an opposite second endmost nozzle of which is disposed a distance D2 from the first endmost cyan nozzle;

an array of magenta nozzles for ejecting magenta ink, a first endmost nozzle of which is disposed proximate the first end of the substrate, and an opposite second endmost nozzle of which is disposed a distance D3 from the first endmost nozzle; and an array of yellow nozzles for ejecting yellow ink, a first endmost nozzle of which is disposed proximate the first end of the substrate, and an opposite second endmost nozzle of which is disposed a distance D4 from the first endmost nozzle, wherein D2, D3 and D4 are equal to or substantially equal to each other, and wherein D1 is greater than D2;

wherein the arrays being first arrays of black nozzles, cyan nozzles, magenta nozzles and yellow nozzles respectively, further comprising:

a second array of black nozzles disposed along an array direction for ejecting black ink, a first endmost black nozzle of which is disposed proximate the second end of the substrate, and an opposite second endmost black nozzle of which is disposed at the distance D1 from the first endmost black nozzle;

a second array of cyan nozzles for ejecting cyan ink, a first endmost nozzle of which is disposed proximate the second end of the substrate, and an opposite second endmost nozzle of which is disposed at the distance D2 from the first endmost cyan nozzle;

a second array of magenta nozzles for ejecting magenta ink, a first endmost nozzle of which is disposed proximate the second end of the substrate, and an opposite second endmost nozzle of which is disposed at the distance D3 from the first endmost nozzle; and a second array of yellow nozzles for ejecting yellow ink, a first endmost nozzle of which is disposed proximate the second end of the substrate, and an opposite second endmost nozzle of which is disposed at the distance D4 from the first endmost nozzle;

wherein the first array of black nozzles is disposed proximate a first side of the substrate and the second array of black nozzles is disposed proximate a second side of the substrate opposite the first side.

6. The inkjet printhead die of claim 5, wherein the substrate has a length L from the first end to the second end, and wherein D1 is approximately equal to two thirds of L.

7. The inkjet printhead die of claim 5, wherein the first arrays of cyan nozzles, magenta nozzles and yellow nozzles include a closest first array to the first array of black nozzles, a next closest first array to the first array of black nozzles and a farthest first array from the first array of black nozzles, wherein the second array of black nozzles is disposed in line with or substantially in line with the farthest first array from the first array of black nozzles.

8. The inkjet printhead die of claim 7, wherein the second arrays of cyan nozzles, magenta nozzles and yellow nozzles include a closest second array to the second array of black nozzles, a next closest second array to the second array of black nozzles and a farthest first array from the second array of black nozzles, wherein the first array of black nozzles is disposed in line with or substantially in line with the farthest second array from the second array of black nozzles.

9. The inkjet printhead die of claim 8, further comprising electrical circuitry disposed between the first array of black nozzles and the second array of black nozzles.

10. The inkjet printhead die of claim 9, wherein the electrical circuitry is disposed between the closest first array of nozzles and the closest second array of nozzles.

11. The inkjet printhead die of claim 8, further comprising:

a first section of electrical circuitry disposed proximate the first array of black nozzles for controlling the firing of the first arrays of black nozzles, cyan nozzles, magenta nozzles and yellow nozzles; and a second section of electrical circuitry disposed proximate the second array of black nozzles for controlling the firing of the second arrays of black nozzles, cyan nozzles, magenta nozzles and yellow nozzles.

12. The inkjet printhead die of claim 11 further comprising interconnecting leads between the first section of electrical circuitry and the second section of electrical circuitry.

13. The inkjet printhead die of claim 12, wherein the interconnecting leads include:

a first interconnecting lead to connect power terminals; and a second interconnecting lead to connect ground terminals.

14. The inkjet printhead die of claim 13, wherein the interconnecting leads further include a third interconnecting lead to connect terminals for synchronization of electrical signals.

15. The inkjet printhead die of claim 12, wherein the first section of electrical circuitry and the second section of electrical circuitry are independently operable if the interconnecting leads are removed.

16. The inkjet printhead die of claim 5, wherein the printhead die is rotationally symmetric.

17. An inkjet printhead comprising:

an inkjet printhead die comprising:

a single substrate having a first end and a second end opposite the first end;

an array of black nozzles disposed along an array direction for ejecting black ink, a first endmost black nozzle of which is disposed proximate the first end of the substrate, and an opposite second endmost black nozzle of which is disposed a distance D1 from the first endmost black nozzle;

an array of cyan nozzles for ejecting cyan ink, a first endmost nozzle of which is disposed proximate the first end of the substrate, and an opposite second endmost nozzle of which is disposed a distance D2 from the first endmost cyan nozzle;

an array of magenta nozzles for ejecting magenta ink, a first endmost nozzle of which is disposed proximate the first end of the substrate, and an opposite second endmost nozzle of which is disposed a distance D3 from the first endmost nozzle; and an array of yellow nozzles for ejecting yellow ink, a first endmost nozzle of which is disposed proximate the first end of the substrate, and an opposite second endmost nozzle of which is disposed a distance D4 from the first endmost nozzle, wherein D2, D3 and D4 are equal to or substantially equal to each other, and wherein D1 is greater than D2; and a mounting support to which the inkjet printhead die is affixed, the mounting support including:

an ink passageway for connecting a source of black ink to the array of black nozzles;

an ink passageway for connecting a source of cyan ink to the array of cyan nozzles;

an ink passageway for connecting a source of magenta ink to the array of magenta nozzles; and an ink passageway for connecting a source of yellow ink to the array of yellow nozzles.

18. An inkjet printer comprising;

a media advance system;

an inkjet printhead comprising:

an inkjet printhead die comprising:

a single substrate having a first end and a second end opposite the first end;

an array of black nozzles disposed along an array direction for ejecting black ink, a first endmost black nozzle of which is disposed proximate the first end of the substrate, and an opposite second endmost black nozzle of which is disposed a distance D1 from the first endmost black nozzle;

an array of cyan nozzles for ejecting cyan ink, a first endmost nozzle of which is disposed proximate the first end of the substrate, and an opposite second endmost nozzle of which is disposed a distance D2 from the first endmost cyan nozzle;

an array of magenta nozzles for ejecting magenta ink, a first endmost nozzle of which is disposed proximate the first end of the substrate, and an opposite second endmost nozzle of which is disposed a distance D3 from the first endmost nozzle; and an array of yellow nozzles for ejecting yellow ink, a first endmost nozzle of which is disposed proximate the first end of the substrate, and an opposite second endmost nozzle of which is disposed a distance D4 from the first endmost nozzle, wherein D2, D3 and D4 are equal to or substantially equal to each other, and wherein D1 is greater than D2; and a mounting support to which the inkjet printhead die is affixed, the mounting support including:

an ink passageway for connecting a source of black ink to the array of black nozzles;

an ink passageway for connecting a source of cyan ink to the array of cyan nozzles;

an ink passageway for connecting a source of magenta ink to the array of magenta nozzles; and an ink passageway for connecting a source of yellow ink to the array of yellow nozzles; and a carriage for moving the inkjet printhead across a print region.

* * * * *